US008092154B2

(12) United States Patent
Jarrah et al.

(10) Patent No.: US 8,092,154 B2
(45) Date of Patent: Jan. 10, 2012

(54) INTEGRATED FAN WITH PUMP AND HEAT EXCHANGER COOLING CAPABILITY

(75) Inventors: Yousef M. Jarrah, Casa Grande, AZ (US); Nigel Strike, Phoenix, AZ (US)

(73) Assignee: Minebea Co., Ltd., Nagano (JP)

( * ) Notice: Subject to any disclaimer, the term of this patent is extended or adjusted under 35 U.S.C. 154(b) by 1056 days.

(21) Appl. No.: 11/958,755

(22) Filed: Dec. 18, 2007

(65) Prior Publication Data

US 2009/0155060 A1 Jun. 18, 2009

(51) Int. Cl.
*F04D 25/16* (2006.01)

(52) U.S. Cl. ..... 415/116; 415/101; 415/121.3; 415/177

(58) Field of Classification Search ..... 415/62, 415/66, 67, 68, 69, 101, 116, 117, 121.3, 415/175, 177; 417/368
See application file for complete search history.

(56) References Cited

U.S. PATENT DOCUMENTS

| | | | | |
|---|---|---|---|---|
| 6,695,579 | B2 | 2/2004 | Meng | |
| 7,262,532 | B2 * | 8/2007 | Seidler et al. | 310/103 |
| 7,292,438 | B2 | 11/2007 | Chen | |
| 7,509,999 | B2 * | 3/2009 | Angelis et al. | 165/247 |
| 7,582,997 | B2 * | 9/2009 | Rojo Lulic | 310/103 |
| 7,780,422 | B2 * | 8/2010 | Berroth | 417/420 |
| 2006/0191669 | A1 | 8/2006 | Chen | |
| 2008/0038126 | A1 | 2/2008 | Berroth | |

* cited by examiner

*Primary Examiner* — Nathaniel Wiehe
(74) *Attorney, Agent, or Firm* — George B. F. Yee; Fountainhead Law Group P.C.

(57) ABSTRACT

Disclosed is a compact and integrated fan, pump, and heat exchanger system where air-cooling is performed via the fan, liquid cooling is performed via a pump, and the drilled pump diffusers act as a heat exchanger. The pump has drilled diffusers through which liquid passes into the volute, the drilled diffusers are streamlined and thus act as fan stator blades. Hot liquid is centrifuged and carried inside the drilled diffusers while air flows around the outside surfaces of the drilled diffusers. A heat transfer occurs where heat transfers from the hot liquid into the air stream.

25 Claims, 6 Drawing Sheets

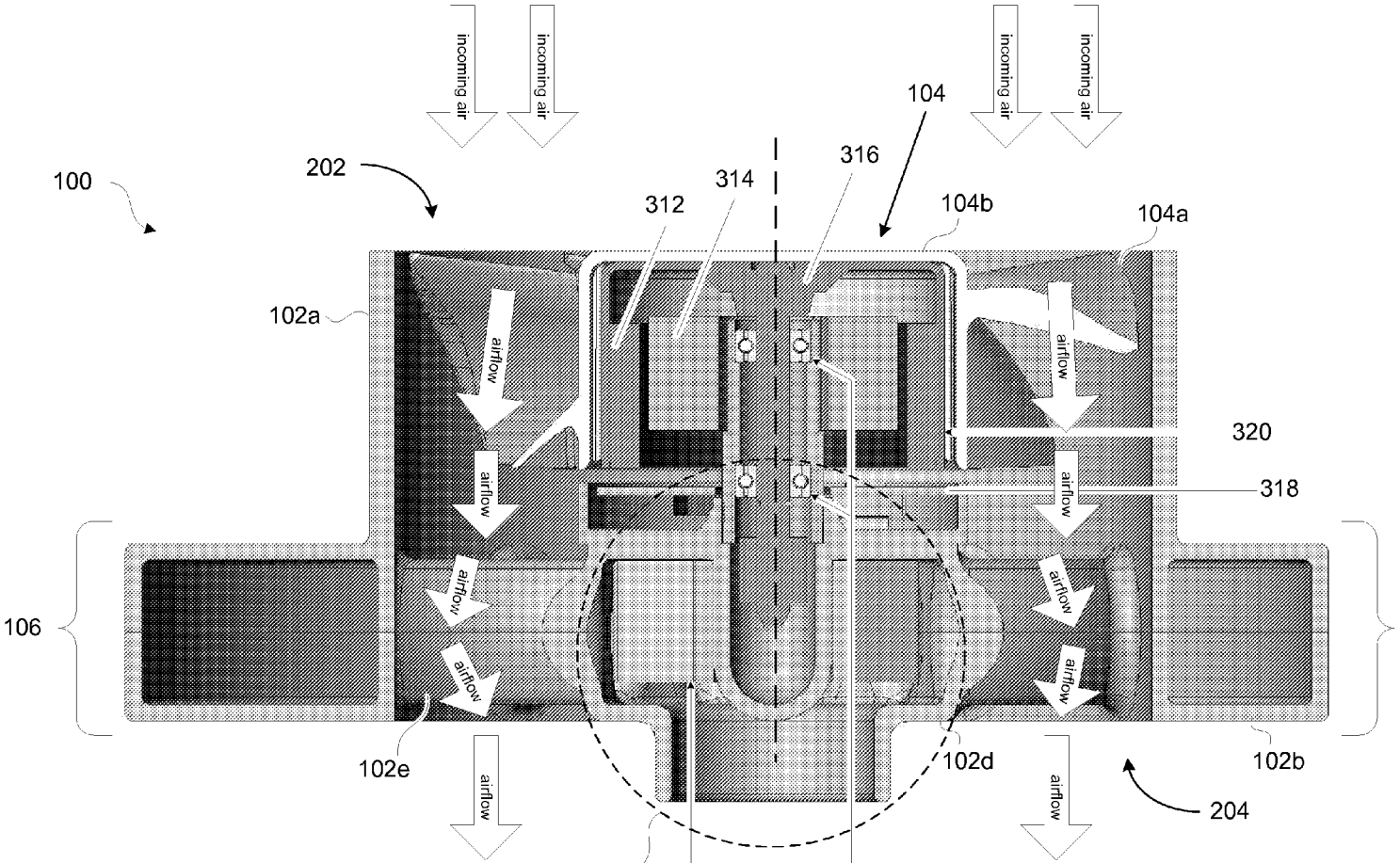
incoming air
incoming air
incoming air
incoming air
airflow
airflow
airflow

INTEGRATED FAN WITH PUMP AND HEAT EXCHANGER COOLING CAPABILITY

BACKGROUND OF THE INVENTION

The present invention is related to fan and pump devices, and more specifically to liquid cooling systems using axial-flow fans and centrifugal pumps. The present invention is still more specifically directed to method and apparatus for liquid cooling using a compact configuration of axial-flow fan and centrifugal pump devices.

Classical cooling units utilize three (3) separate components (fan, pump, and heat exchanger) located far apart to continuously perform the desired function of removing heat out of a liquid. For example, automobiles have a cooling system which includes a fan, a pump, and a heat exchanger. Some electronics and avionics cooling systems also include the same three basic components, and some home air conditioning systems also utilize all three components.

The basic three components perform three basic functions: the fan delivers cold air; the pump delivers hot liquid; and the heat exchanger transfers heat from the liquid to the air. These three individual components are typically located far apart and thus occupy a large overall volume.

Axial flow fans are fans in which the direction of the flow of the air from inlet to outlet remains unchanged. Guide, or stator, vanes can be provided to smooth the airflow by minimizing or otherwise reducing swirl and thus improve air flow efficiency.

Centrifugal pumps are pumps that use a rotating impeller to increase the pressure of a fluid. The fluid enters the pump impeller along or near to the rotating axis and is accelerated by the impeller, flowing radially outward into a diffuser or chamber of a volute, from where it exits an outlet, and into a downstream piping system for example. A centrifugal pump typically includes a rotating impeller that increases the velocity of the incoming fluid. A casing, or volute, of the pump then acts to convert this increased velocity into an increase in pressure, resulting in fluid flow. The centrifugal pump typically employs a diffuser to deliver the liquid radially into the volute and then into the outlet.

BRIEF SUMMARY OF THE INVENTION

The present invention provides a liquid cooling system comprising a unique combination of a fan and a unique pump/heat exchange component, thereby avoiding the need for a separate, space-consuming heat exchanger. The result is a compact and lower cost thermal system for liquid cooling. Of course, any fluid (such as air or other gases) other than a liquid can be cooled according to the present invention.

The inventors have coined the term "fanpump" to describe a class of turbomachines which comprise two-wheels rotating about a common shaft, the first wheel is an axial-flow fan and the second wheel is a centrifugal pump. The present invention integrates three functions, namely, air cooling, liquid cooling, and heat exchange into this single two-wheel turbomachine. The fan delivers air while the pump delivers liquid. The third function is performed at the interface of the pump drilled diffusers since liquid flows inside the drilled diffusers while air flows around the drilled diffusers. Thus, although only two components (fan plus pump) are integrated, the "fanpump" device performs three (3) functions: the fan delivers air for cooling; the pump delivers liquid to be cooled; and at the surface of the drilled diffusers heat is transferred from liquid to air to effect cooling of the liquid.

The fanpump cooling device, apparatus, or system can be driven by a common drive source, such as a common drive shaft. In the case of a motor-driven device, the drive shaft can be driven by a single motor. Still another alternative is to drive the fan portion of the fanpump device and the pump component with separate, independently controlled drive sources.

The present invention provides an integrated fan plus a pump and heat exchanger housed in a compact cooling system. Air cooling is provided via an airflow created by the axial-flow fan, liquid cooling is provided via the centrifugal pump, and a heat transfer process is performed at the surface of the drilled pump diffuser elements of the centrifugal pump where heat transfers from the relatively hot liquid to the air stream. The fan and the pump rotate about a common shaft. Cooling devices according to the present invention perform three functions simultaneously: the fan delivers pressurized air flow; the pump delivers pressurized liquid; and heat is exchanged as the hot liquid is diffused inside the drilled pump diffusers while air is flowing about the drilled pump diffusers.

The present invention eliminates the need for a separate heat exchanger by providing fluid flow within hollow diffuser elements (or channel elements) of the pump. The present invention provides for axial airflow across the diffuser elements. Heat transfer is performed as the hot liquid flows inside the diffuser elements while the colder axial airflow passes across the outside of the diffuser elements. In the present invention, the diffuser elements of the centrifugal pump therefore serve to diffuse the liquid and to provide a heat transfer path for hot liquid flowing inside the diffuser element to the air outside.

The present invention further provides for the diffuser elements of the centrifugal pump to serve as guard or stator blades to eliminate, minimize, or otherwise reduce swirling activity in the airflow of the axial fan.

BRIEF DESCRIPTION OF THE DRAWINGS

FIGS. 3B and 3C are plan views of the cutaway section illustrated in FIG. 3A.

DETAILED DESCRIPTION OF THE INVENTION

Figure 1A:
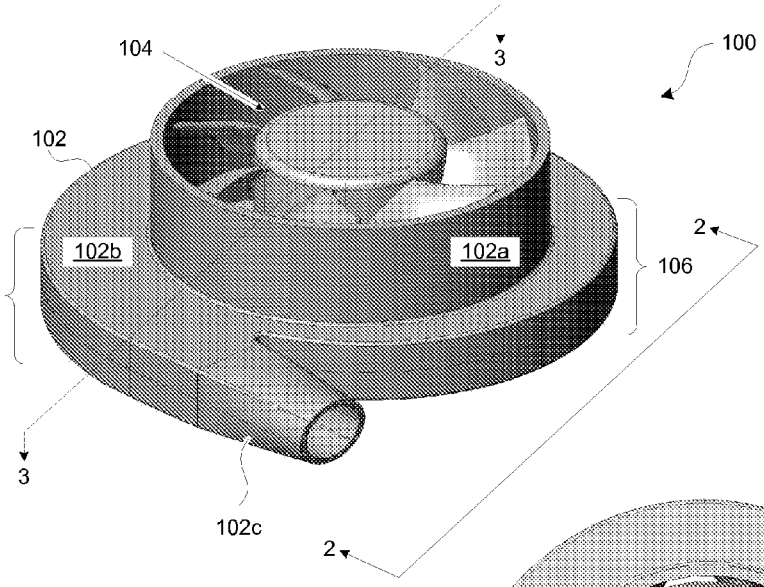
FIGS. 1A-1C show three views of an illustrative embodiment of an apparatus for cooling liquids in accordance with the present invention.
Figure 1B:
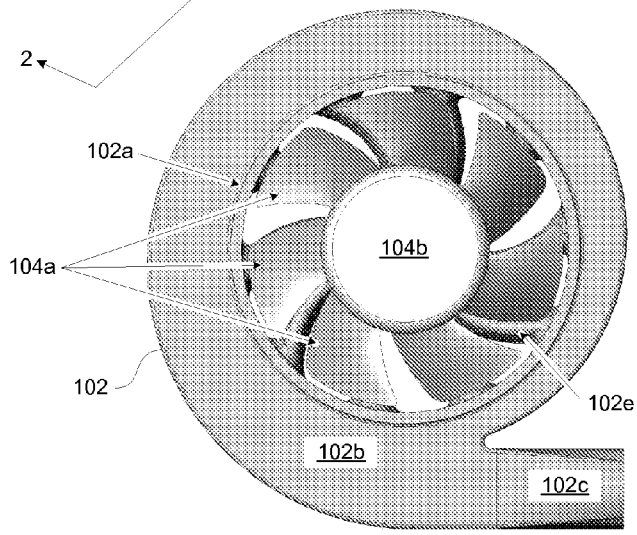
Figure 1C:
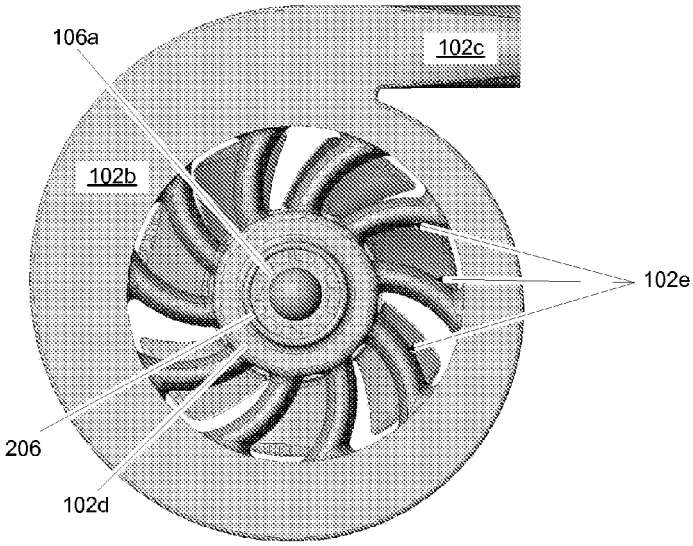

FIGS. 1A-1C show various exterior views of a cooling apparatus 100 according to an embodiment of the present invention. FIG. 1A is a perspective upper view of the cooling apparatus 100, while FIG. 1B is a top view looking down at the apparatus and FIG. 1C is a bottom view looking up. The cooling apparatus 100 includes among other elements to be discussed below, a housing 102 that houses an axial fan 104 and a centrifugal pump 106. The cross-sectional view of FIG. 3B more clearly shows the centrifugal pump 106. Axial fan and mixed-flow fan designs are known. Though embodiments disclosed herein show an axial fan, it is noted that fan 104 can be a mixed-flow fan in an alternate embodiment of the present invention. Likewise, the centrifugal pump and mixed-flow pump designs are known. Thus, although embodiments disclosed herein show a centrifugal pump, it is noted that pump 106 can be a mixed-flow pump.

Portions of the housing 102 of the cooling apparatus 100 in accordance with the present invention uniquely provide an enclosure (shroud 102*a*) for the axial fan 104 and at the same time provide various components for the centrifugal pump 106. For example, the housing 102 defines a fan housing for the axial fan 104. A portion of the housing 102 serves as a fan shroud 102*a* for the fan 104. The axial fan 104 sits within the space defined by the fan shroud 102*a*. The fan 104 comprises fan blades 104*a*. The fan blades 104*a* are connected to a fan hub 104*b*. The combination of the blades and hub is referred to as the impeller. The axial fan 104 shown in this and following figures is a generic fan design. However, a variety of axial fans and designs are known. Various fan blade (impeller) designs are known. It will be appreciated from the teachings of the present invention, that any suitable axial fan and impeller design can be used.

In accordance with the present invention, the housing 102 also defines various components comprising the centrifugal pump 106. For example, a pump shroud 102*d* houses a pump impeller component 106*a* of the centrifugal pump 106. The view of FIG. 1C shows only a small portion of the pump shroud 102*d*. A more complete view of the pump shroud 102*d* is given in FIG. 3B. The pump shroud 102*d* defines a pump inlet 206 (FIG. 2) of centrifugal pump 106 within which is disposed the pump impeller 106*a*.

The housing 102 also defines a diffuser component for the centrifugal pump 106 which is in fluid communication with the pump shroud 102*d*. Fluid entering the inlet 206 is forced under the pressure created by operation of the pump impeller 106*a* to flow into the diffuser. Unlike conventional diffuser designs, the housing 102 in accordance with the present invention defines a plurality of diffusers 102*e*. The diffusers 102*e* shown in the top view of FIG. 1B are partially obscured by the impellers 104*a*, but are shown in full view in FIG. 1C. A feature unique to the present invention is the shape of the diffusers 102*e*, they have a blade shape and thus are referred to herein as "diffuser blades" or "diffuser elements." This aspect of the present invention will be discussed in further detail below.

The housing 102 also defines the volute of the centrifugal pump 106 that is in fluid communication with the diffuser blades 102*e*. In accordance with the present invention, the housing 102 defines a hollow casing 102*b* which serves as the volute. Fluid flowing through the diffuser blades 102*e* will exit the diffuser blades into the chamber of the volute 102*b*. The housing 102 also defines a portion 102*c* which provides the pump outlet 208 of the centrifugal pump 106.

FIGS. 1A-1C show a unique combination of the axial fan 104 and the pump 106 integrated into a single compact unit requiring only a single housing 102 and single shaft (FIG. 3B) to drive both. Air flows along the axis of rotation via the action of the fan impeller 104*a*, and the fluid to be cooled is centrifuged via the action of the pump impeller 106*a*.

Figure 2:
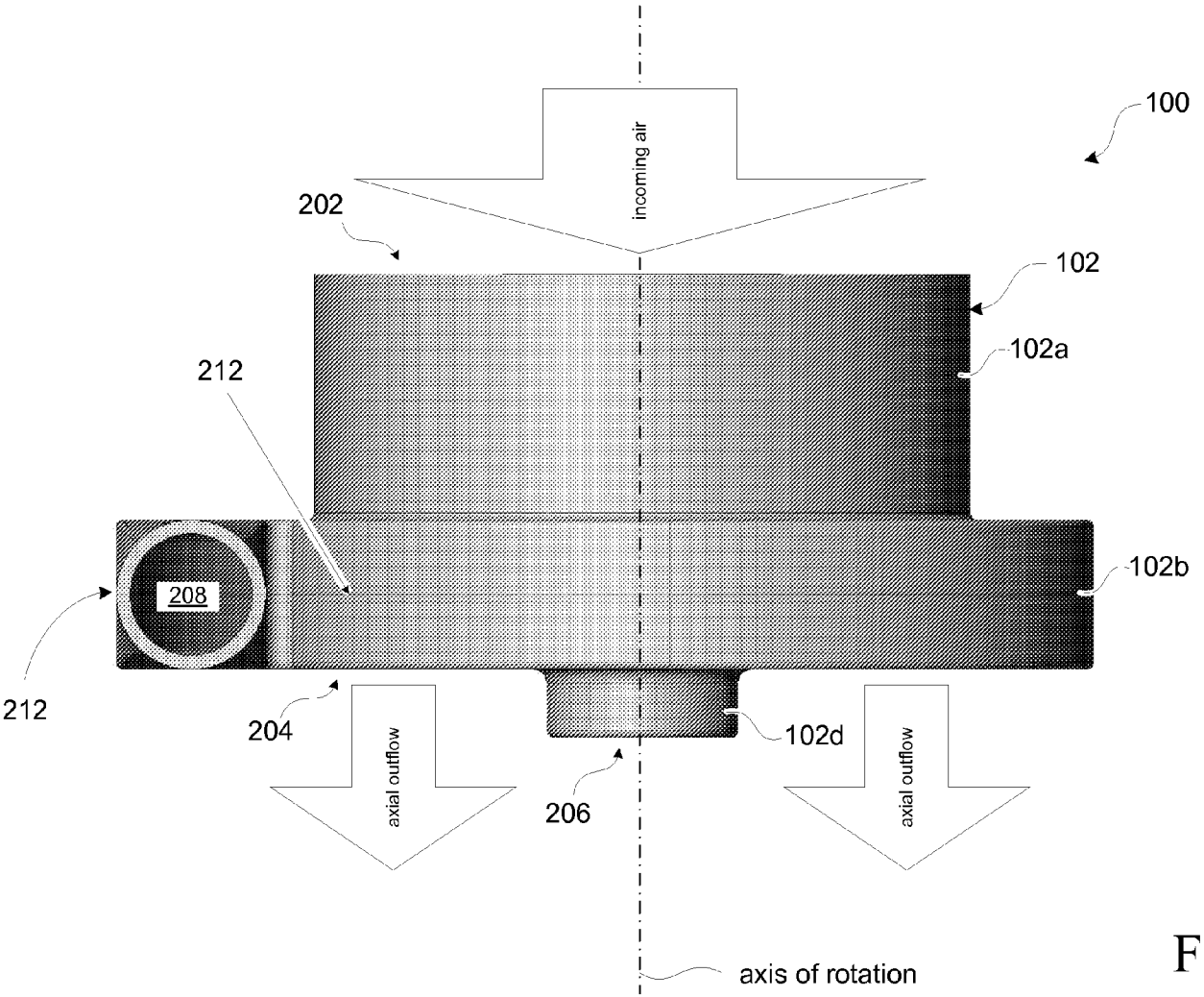
FIG. 2 is a side view of an illustrative embodiment of the apparatus shown in FIG. 1A.

FIG. 2 represents a side view of the illustrative cooling apparatus 100 of FIG. 1 taken from the view line 2-2 shown in FIG. 1A. This figure is used to illustrate the various fluid flows of the apparatus 100. Operation of the fan 104 will create a pressurized air flow. The incoming air enters through the airflow inlet 202 and is pressurized when the impeller 104 is spinning. This creates an axial flow of air that exits via the airflow outlet 204.

In an embodiment of the present invention, the housing 102 comprises two halves which fit together. A seem line 212 illustrated in FIG. 2 represents the line of contact between the two halves of the housing 102. The seem line can be seen in the other figures as well.

Figure 3A:
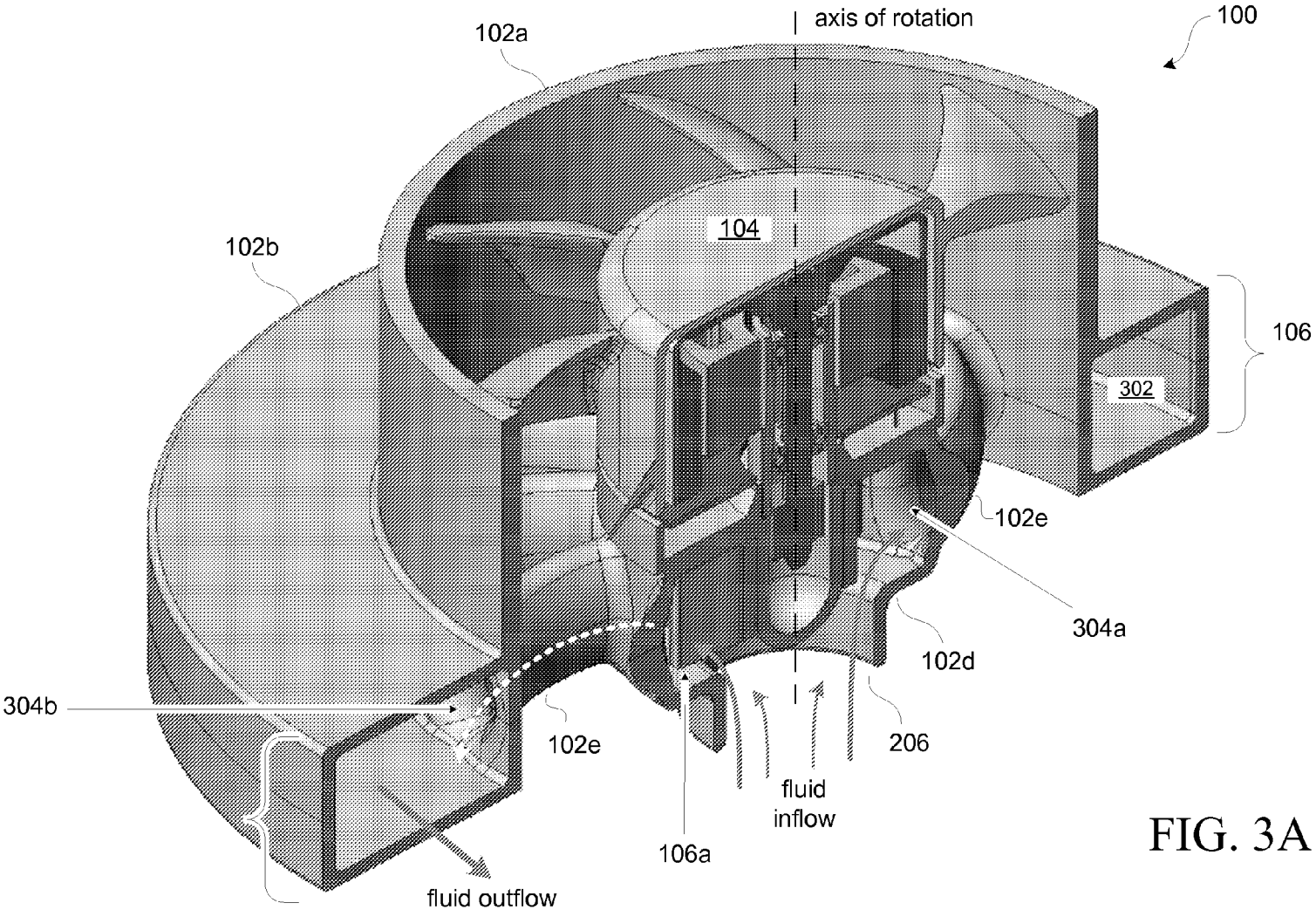
FIG. 3A is a perspective cutaway view of an illustrative embodiment of the apparatus shown in FIG. 1A.

FIG. 3A shows a perspective cutaway view of the illustrative embodiment of the cooling apparatus shown in FIG. 1A, taken from the view line 3-3. This figure shows more clearly the integration of the axial fan 104 and centrifugal pump 106 in accordance with the present invention.

As discussed above, a unique feature of the centrifugal pump 106 in accordance with the present invention is the array of diffuser blades 102*e* which collectively function as a conventional diffuser in a conventional centrifugal pump. Each diffuser blade 102*e* has an opening 304*a* into the volume of space defined by the pump shroud 102*d*, where fluid entering inlet 206 is pressurized by pump impeller 106*a*. Each diffuser blade 102*e* also has an opening 304*b* into the volute chamber 302, where fluid flowing through the diffuser blade exits.

As illustrated in FIG. 3A, fluid enters the centrifugal pump 106 via the pump inlet 206. In a specific application of the cooling apparatus 100, a source of fluid to be cooled is connected to the pump inlet 206. Though no details are provided in the figure, it is understood that the pump inlet 206 can be provided with a suitable fluid coupling mechanism to connect the apparatus 100 to a fluid source. The fluid can be a gas, but is more commonly a liquid such as water or other liquid coolant. Fluid entering the inlet 206 is pressurized by the spinning action of the pump impeller 106*a*, forcing the fluid into the diffuser blades 102*e* through the respective openings 304*a*. Fluid continues to flow through the diffuser blades 102*e* where it exits through respective openings 304*b* and into volute chamber 302. As can be seen in FIG. 1C, the diffuser blades 102*e* have a curved structure which directs the fluid in toward the outlet 208.

FIG. 3B shows a straight-on view of the cutaway section illustrated in FIG. 3A. In a particular embodiment of the present invention, the axial fan 104 is driven by a motor provided in the fan hub 104*b*. FIG. 3B illustrates an example of a brushless DC (direct current) motor 320. It will be appreciated that any of a number of suitable conventional motor designs can be used, including brushed as well as brushless motors. The brushless motor 320 shown in FIG. 3B includes a permanent magnet rotor 312 connected to the hub 104*b*, so that rotation of the rotor will cause a corresponding rotation of the hub. The rotor 312 is attached or otherwise connected to a drive shaft component (spindle, axis, etc.) 316 for rotation about an axis of rotation. A stator 314 (more specifically a stator coil or stator winding in the case of brushless motors) is fixedly attached about the drive shaft 316. Motor drive electronics 318 are provided on printed circuit board mounted near the base of the motor 320. Suitable connections are made between the motor 320 and the drive electronics 318, for example in order to provide drive current to the stator windings of stator 314, and in general to provide communication between the motor and the drive electronics.

In accordance with the present invention, the centrifugal pump 106 is driven by the same motor 320. In particular, the impeller 106*a* is mechanically coupled to the drive shaft 316, permitting the one motor to drive both devices, namely the fan 104 and the pump 106. The single motor, common drive shaft configuration is advantageous in that it allows for a simple, compact, and low cost unit.

However, it will be appreciated that alternative drive configurations, nonetheless, can be employed. For example, a common drive can be provided using a common drive shaft where the motor drive is provided at a location separate from the cooling apparatus 100. It may be desirable to drive the fan 104 with a source separate from the drive source for the pump 106. For example, it might be desirable to control the airflow velocity of the fan 104 and the fluid flow rate of the pump 106 independently of each other. Still other drive configurations can be employed without departing from the teachings of the present invention.

FIG. 3B shows how heat is transferred from hot liquid to the air in accordance with the present invention. The figure shows the path of the airflows created during operation of the fan 104. Air is pulled into the airflow inlet 202 of shroud 102*a* and is forced through the shroud to create an axial airflow that exits the airflow outlet 204. Along the way, the airflow passes across the surfaces of the diffuser blades 102*e* which are located in the path of the airflow and downstream of the airflow. When a fluid hotter than the airflow is made to flow through the diffuser blades 102*e*, heat from the fluid will conduct across the material of the diffuser blades and into the air of the airflow, thus cooling the fluid. It is noted that the direction of the airflow can be reversed; however, the cooling effect will be reduced.

Figure 3C:
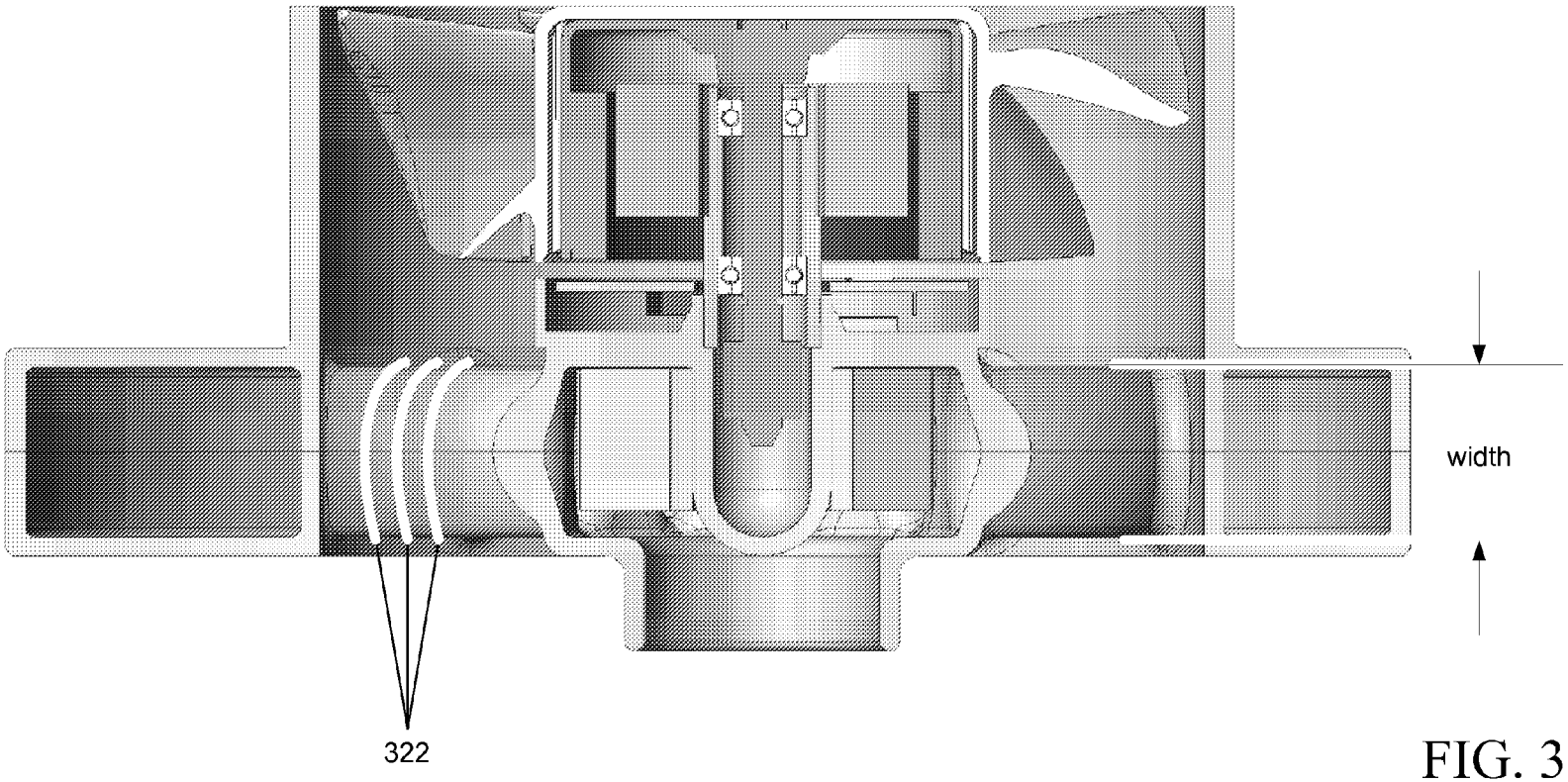

The width dimension shown in FIG. 3C of the diffuser blades 102*e* can be increased or decreased to provide greater or lesser surface thereby affecting the rate of thermal conduction for any given fanpump design. FIG. 3C shows the addition of "winglets" (or fins) 322 that can be formed on the surface(s) of the diffuser blades 102*e*. The winglets 322 further increase the surface area of the diffuser blade 102*e* for increased heat exchange capacity. The design and number of winglets 322 may be the same for each diffuser blade 102*e*, or can vary from one blade to another. Typically the winglets 322 extend from the surface of the diffuser blade 102*e* by a small distance, e.g., the thickness of a dime, but the specific dimension will depend on a specific application.

It is understood that larger and/or more numerous winglets 322 will improve heat exchange capacity, but generally at the cost of decreased airflow. Similarly, for the diffuser blades 102*e*, namely, larger and/or more diffuser blades 102*e* will improve heat exchange capacity, generally sacrificing airflow efficiency. The specific designs for the diffuser blades 102*e* and the winglets 322, including numbers of diffuser blades and winglets, will be dictated by the requirements of a specific application. Such design factors are beyond the scope of the present invention, but are nonetheless within the scope of understanding of those of ordinary skill in the art.

Figure 4:
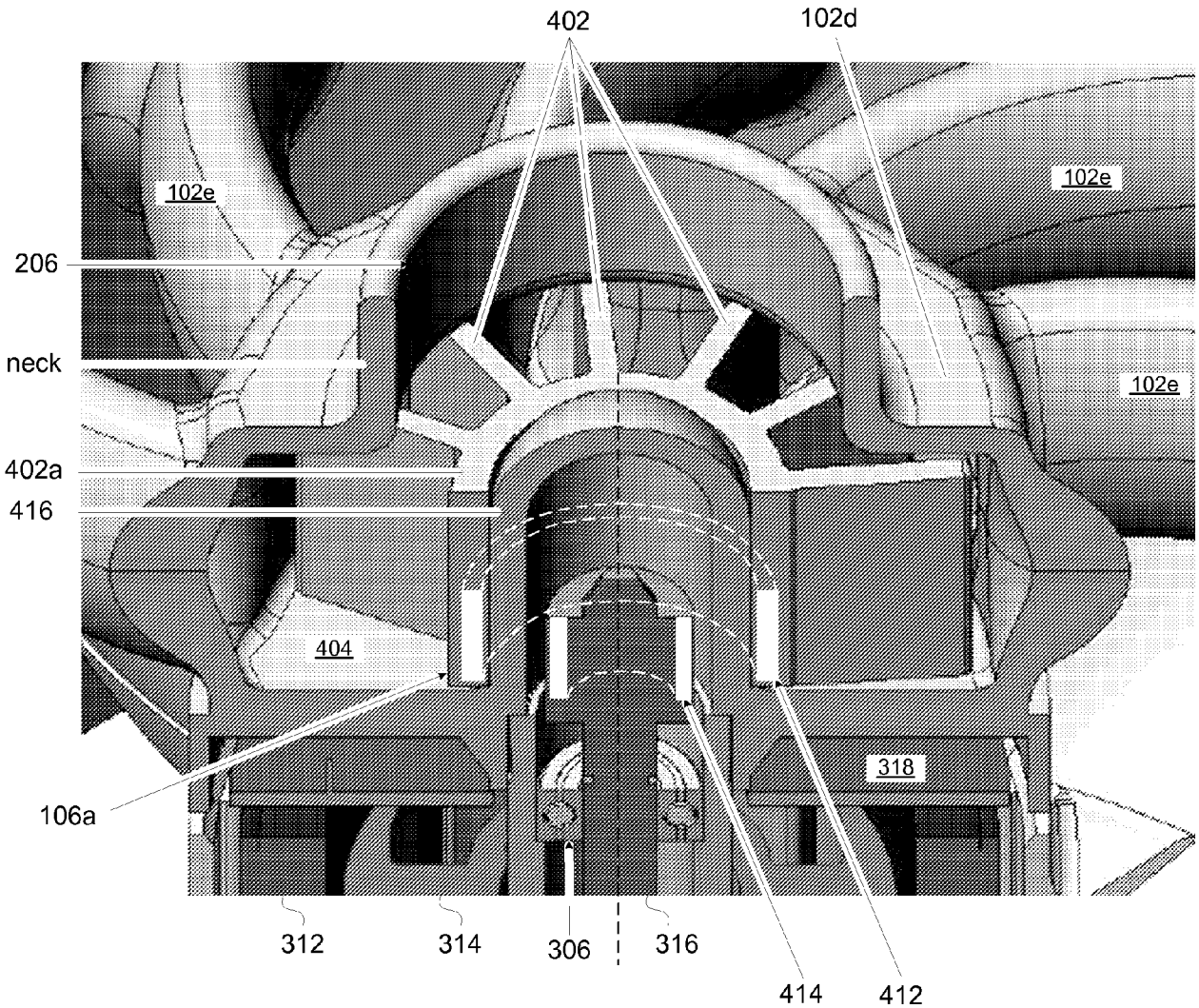
FIG. 4 is a blown up view of an area identified in FIG. 3B.

An enlarged view of the area in FIG. 3B identified by circle 4 is shown, upside down, in perspective in FIG. 4 and illustrates some additional details of the centrifugal pump 106. As can be seen in FIG. 4, the pump impeller 106*a* comprises impeller blades 402 attached to and radially arranged about an impeller ring 402*a*. The impeller ring 402*a* slidably fits about a finger 416. The pump impeller 106*a* spins about the finger 416 within the volume of space 404 defined by the pump shroud 102*d*.

A neck of the shroud 102*d* defines fluid inlet 206 and can be structured or otherwise fitted with a suitable coupling device to allow for cooling apparatus 100 to be connected to the source of fluid to be cooled. Diffuser blades 102*e* can be seen coupled to the pump shroud 102*d*.

FIG. 4 also shows portions of the motor drive components. For example, a portion of the stator 314 of motor 320 can be seen. Similarly, part of the permanent magnet rotor 312 can be seen. The PCB containing the drive circuitry 318 is also visible. As can be seen in the figure (also in FIGS. 3A and 3B), bearings 306 provide support for the drive shaft 316 within the housing 102.

In the embodiment of the present invention shown in FIG. 4, the ring of pump impeller 106*a* is provided with a permanent magnet ring 412. A corresponding permanent magnet ring 414 is provided about drive shaft 316. The magnets 412, 414 are aligned for mutual attraction between them so that when the drive shaft 316 spins the magnet 414, the magnet 412 likewise will spin thus driving the pump impeller 106*a*. As can be seen in the figure, the finger 416 provides a fluid-tight separation between the pump mechanics of the pump 106 and the fan mechanics of the fan 104.

An important aspect of the present invention are the drilled diffuser blades 102*e* which constitute a component of the centrifugal pump 106. First, as discussed above, they collectively perform the function of a conventional diffuser in a conventional centrifugal pump, namely to deliver the pressurized incoming fluid created by the impeller into to volute.

A second important aspect of the present invention, as can be seen in the figures, is that the diffuser blades 102*e* are disposed in the path of the airflow of the axial fan 104. Thus, the flow of fluid resulting from the pressure created by the spinning of the pump impeller 106*a* flows through the diffuser blades 102*e* which are connected to the pump shroud 102*d* and in fluid communication with the volume 404 within the shroud. The fluid consequently also flows in the path of the airflow of the axial fan 104. The diffuser blades 102*e* thus act as heat exchangers where heat is transferred from the hot fluid stream inside the diffuser blades to the cooler air stream outside.

A third important aspect of the present invention is the shape of the diffuser blades 102*e*. As can be seen in the figures, the diffuser blades 102*e* have a streamline shape. By placing the diffuser elements of the centrifugal pump 106 squarely within the path of the airflow (airstream), turbulence and swirl effects can arise in the airflow. By shaping the diffuser elements of the centrifugal pump to have a streamlined, aerodynamic shape, the diffuser blades 102*e* can de-swirl the airflow. Because the drilled diffuser blades are streamlined (i.e. outer surface is airfoil shaped) and located downstream of the fan impeller 104*a* they also act like de-swirl vanes (i.e., fan stator blades which remove swirl, created by the fan impeller, from the air stream).

In a particular embodiment, the diffuser blades 102*e* have an airfoil shape, and more generally have the general shape of a fan blade; hence the inventors have coined the phrase "diffuser blade" as a reminder that the diffuser elements of the present invention have two important functions: first, they are drilled so as to centrifuge (or diffuse) the fluid captured by the pump impeller 106*a*; and second, they are streamlined, i.e., they look like airfoils or fan blades in order to eliminate, minimize, or otherwise reduce air swirl and/or turbulence. The diffuser blades 102*e* therefore serve as conventional "stator blades."

It is noted that de-swirling the airflow, though very desirable, is not a critical element of the present invention though it is nonetheless a unique feature of the present invention. Aspects of the present invention include the placement of the diffuser blades 102*e* within the path of the airflow, allowing for the airflow to cool the hotterliquid flowing within the diffuser blades, and allowing for the ability to at least reduce swirl from the airflow. Thus, the diffuser blades 102*e* in accordance with the present invention perform three functions: they diffuse the fluid, they provide heat exchange, and they can de-swirl the airflow.

Another important aspect of the present invention is the integration of the axial fan 104 and the centrifugal pump 106 into a single unit, where the two rotating wheels (fan impeller 104*a* and pump impeller 106*a*) have a common shaft, motor, and drive housed in a common housing 102. The inventors have coined the descriptive term "fanpump" to describe such devices. The centrifugal pump design of the present invention allows for the diffuser component of the pump 106 to be placed inline with the airflow of the fan 104 in a compact, space-efficient manner. The design and placement of the volute 102*b* of the pump 106 is equally important in arriving at a compact, space-efficient device.

As noted above, the housing 102 can be formed of two halves (or more pieces). Each half (piece) can be an injection molded piece. The material can be any suitable type of plastic, or any other material. Preferably, the material that is used has suitable thermal qualities as to promote efficient heat conduction in the diffuser blades 102*e*.

In an embodiment, the diffuser blades 102*e* can be formed of material different from the rest of the housing 102. Though manufacture of such an embodiment might be more costly due to increased complexity in the manufacture, it may be acceptable if the diffuser blades 102*e* can achieve high thermal efficiency.

Still other variations are contemplated without departing from the present invention teachings. For example, the axial fan 104 and the centrifugal pump 106 can be driven by separate drive sources. Though this may result in a less compact design and a single drive configuration, a particular application may call for a less compact design; e.g., there may be a benefit to be able to drive the axial fan at speeds, or otherwise be controlled, separately from the pump.

What is claimed is:

1. A heat exchanger for cooling a liquid comprising:
a housing having an axial inlet and an axial outlet; and
an axial fan disposed within the housing to produce a flow of air along an axis of rotation of the axial fan, the flow of air entering the axial inlet and exiting the axial outlet,
the housing further having:
a fluid inlet;
a plurality of blade-shaped static elements disposed in the path of the flow of air, arranged radially about the axis of rotation, and connected to the fluid inlet; and
a fluid chamber connected to the blade-shaped static elements,
each blade-shaped static element having a hollow construction and having an interior volume that provides a channel between the fluid inlet and the fluid chamber,
wherein the blade-shaped static elements carries a fluid to be cooled from the fluid inlet to the fluid chamber, whereby heat is conducted from the fluid to be cooled as the flow of air passes across surfaces of the blade-shaped static elements.

2. The heat exchanger of claim 1 further comprising a motor coupled to a fan impeller of the axial fan to produce the flow of air, the heat exchanger further comprising a pump impeller coupled to the motor to pump fluid entering the fluid inlet into the blade-shaped static elements.

3. The heat exchanger of claim 1 wherein the fluid chamber includes a fluid outlet to allow fluid contained therein to exit.

4. The heat exchanger of claim 1 wherein the blade-shaped static elements have a airfoil shape to at least reduce swirl in the flow of air.

5. The heat exchanger of claim 1 wherein some of the blade-shaped elements include fins disposed about their respective exterior surfaces.

6. A heat exchange device for cooling a liquid comprising:
a fan for producing an airflow; and
a pump having fluid components including a fluid inlet, a plurality of channels in fluid communication with the fluid inlet to receive a fluid entering the fluid inlet, a collection chamber in fluid communication with the channels to receive fluid exiting the channels, and a fluid outlet formed in the collection chamber through which fluid from the collection chamber is expelled,
wherein the channels are placed in the path of the airflow produced by the fan,
wherein a heated fluid flowing within the channels is cooled by thermal conduction as the airflow passes across the surfaces of the channels.

7. The device of claim 6 further comprising a rotary drive coupled to the fan to provide mechanical energy to the fan to produce an airflow and further coupled to the pump to provide energy to pump fluid into the channels and into the collection chamber.

8. The device of claim 6 wherein the fan and the pump have a common axis of rotation.

9. The device of claim 6 wherein the channels are radially disposed about an axis of rotation of the fan, wherein the collection chamber is an annular chamber encircling the airflow, wherein the channels extend across the path of the airflow produced by the fan.

10. The device of claim 9 wherein at least some of the channels have the shape of a fan blade.

11. The device of claim 6 further comprising a housing, the housing including a shroud to house the fan and through which the airflow passes, wherein the pump components are defined by the housing.

12. The device of claim 6 wherein the fan is an axial fan or a mixed-flow fan.

13. The device of claim 6 wherein the pump is centrifugal pump or a mixed-flow pump.

14. The device of claim 6 wherein some of the channels have fins disposed on respective exterior surfaces thereof.

15. A heat exchange device comprising:
a fan to produce an airflow along an axis of rotation of the fan during operation of the fan; and
a pump to pump a fluid to be cooled,
the pump comprising:
a fluid inlet to receive the fluid to be cooled;
a diffuser array coupled to the fluid inlet into which the fluid to be cooled diffuses; and
a volute coupled to the diffuser array into which the fluid to be cooled empties, the volute having an outlet out of which the fluid to be cooled is expelled,
the diffuser array disposed in the path of the airflow so that the airflow contacts and flows across surfaces of the diffuser array,
whereby heat exchange occurs between air in the airflow and the fluid to be cooled flowing within the diffuser array.

16. The device of claim 15 wherein the fluid inlet is aligned with the axis of rotation of the fan, wherein the diffuser array comprises a plurality of diffuser elements radially disposed about and coupled to the fluid inlet, whereby the diffuser elements are disposed in the path of the airflow.

17. The device of claim 16 wherein the diffuser elements have a blade shape.

18. The device of claim 16 the diffuser elements have an aerodynamic shape.

19. The device of claim 15 further comprising a housing to house the fan, wherein the fluid inlet, the diffuser array and the volute are formed of the housing.

20. The device of claim 15 further comprising a motor, wherein the fan comprises a fan impeller coupled to the motor to produce the airflow, wherein the pump further comprises a pump impeller coupled to the motor to pump the fluid to be cooled.

21. A liquid cooling device comprising:
first means for producing an airflow; and
second means for pumping a liquid to be cooled through channels disposed in the path of the airflow, whereby the airflow passes across surfaces of the channels thereby effecting a heat exchange between liquid flowing through the channels and the air of the airflow, wherein the channels have the shape of a fan blade to reduce swirl in the airflow, the second means for further housing the first means.

22. The device of claim 21 wherein the first means is an axial fan or a mixed-flow fan.

23. The device of claim 21 wherein the second means is a centrifugal pump or a mixed-flow pump.

24. The device of claim 21 wherein the second means is a pump having a portion thereof that contains the first means and defines an airflow inlet and an airflow outlet for the airflow, wherein the channels are disposed closer to the airflow outlet than to the inflow outlet.

25. The device of claim 21 wherein at least some of the channels have fins disposed about exterior surfaces thereof.

* * * * *